US006368240B1

(12) United States Patent
Pohrer

(10) Patent No.: US 6,368,240 B1
(45) Date of Patent: Apr. 9, 2002

(54) ADJUSTABLE HEIGHT BASKETBALL BACKBOARD

(75) Inventor: Christopher M. Pohrer, St. Louis, MO (US)

(73) Assignee: Aalco Manufacturing Company, St. Louis, MO (US)

( * ) Notice: Subject to any disclaimer, the term of this patent is extended or adjusted under 35 U.S.C. 154(b) by 0 days.

(21) Appl. No.: 09/439,730

(22) Filed: Nov. 12, 1999

(51) Int. Cl.[7] ..... A63B 63/08
(52) U.S. Cl. ..... 473/483
(58) Field of Search ..... 473/483; 248/539, 248/219.4, 274.1

(56) References Cited

U.S. PATENT DOCUMENTS 4,643,422 A * 2/1987 Cramblett
5,279,496 A * 1/1994 Schroeder
5,800,296 A * 9/1998 Shaw
6,056,654 A * 5/2000 Schroeder

* cited by examiner

*Primary Examiner*—William M. Pierce
(74) *Attorney, Agent, or Firm*—Armstrong Teasdale, LLP

(57) ABSTRACT

A basketball backboard mounting system includes a stationary member that provides support for a basketball backboard assembly. The mounting system combines a support system including a plurality of hollow members and an actuator system for easily adjusting the support system. The support system includes a stationary member mounted perpendicularly with respect to a floor. The actuator system includes a plurality of adjustable brackets which attach to a basketball backboard, an adjustable structural member which is in slidable contact with the stationary member, and a drive mechanism which easily adjusts the height from the floor of the basketball backboard assembly. The adjustable structural member is telescoping and provides enough support to a basketball backboard to eliminate potentially damaging torsional forces on the basketball backboard.

10 Claims, 6 Drawing Sheets

ADJUSTABLE HEIGHT BASKETBALL BACKBOARD

BACKGROUND OF THE INVENTION

This invention relates generally to basketball backboards and, more particularly, to adjustable height mounting systems for basketball backboards.

A basketball backboard is normally supported from above so that a basketball rim mounted to the backboard is positioned at a height of ten feet above a floor. This height is formidable for shorter players and nearly impossible for children. Adjustable-height backboard supports permit the basketball backboard to be lowered so that the basketball rim is positioned at a height of eight feet for grade-school gymnasiums. Unfortunately, typically, these basketball backboard assemblies require tedious on-site assembly and the installation of additional support tubing and a crank-type adjustment assembly. Furthermore, often these systems are supported from below, creating a potential hazard near a basketball court.

While these assemblies position a basketball rim eight feet above the ground, the assemblies typically require continuous maintenance including re-tightening of the installed components. Although crank-type adjustments are installed, the systems are unreliable, time-consuming, and difficult for an individual to adjust. Furthermore, the assemblies are typically not supported as rigidly as the non-modified equipment and over time the additional support tubing fatigues and requires replacement.

Accordingly, it would be desirable to provide a basketball backboard assembly that can be easily adjusted by an individual, does not require continuous maintenance, and is easily adapted to existing overhead basketball backboard assemblies.

BRIEF SUMMARY OF THE INVENTION

In an exemplary embodiment of the invention, an adjustable height basketball backboard mounting system provides a reliable mounting system that easily attaches to existing support systems and is quickly adjustable by an individual.

The basketball backboard mounting system includes a stationary member that provides support for a basketball backboard assembly. The mounting system combines a support system that includes a plurality of hollow members and an actuator system for easily adjusting the support system. The support system includes a stationary member mounted perpendicularly with respect to a floor. The actuator system includes a plurality of adjustable brackets which attach to a basketball backboard, an adjustable structural member which is in slidable contact with the stationary member, and a drive mechanism which easily adjusts the height from the floor of the basketball backboard assembly.

As a result, a basketball backboard assembly is easily adjustable by an individual, is rigid enough not to require continuous maintenance, and is easily assembled when compared to known adjustable backboard assemblies.

DETAILED DESCRIPTION OF THE INVENTION

Figure 1:
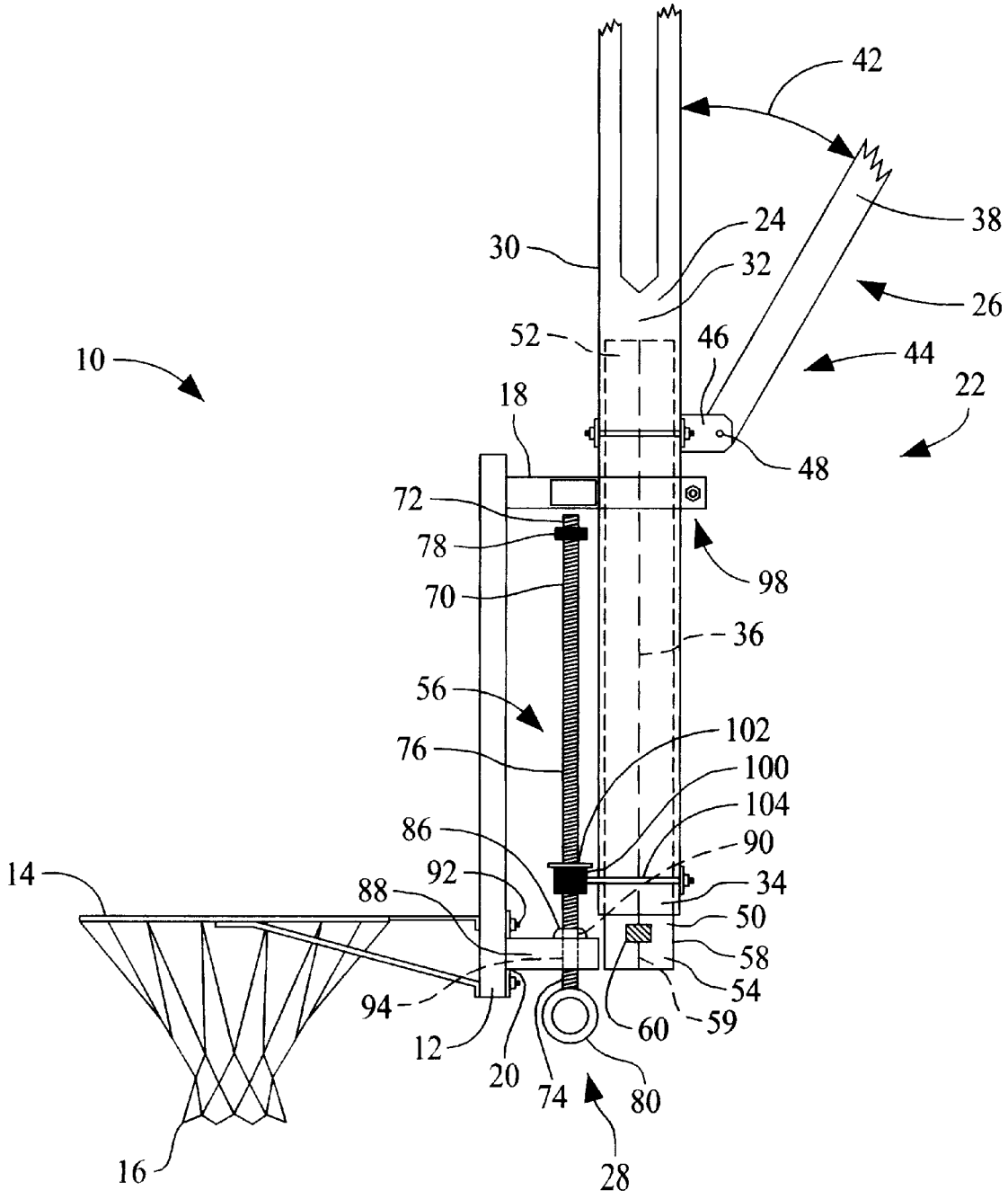
FIG. 1 is a side view of a mounting system for supporting a basketball backboard in accordance with one embodiment of the present invention.

FIG. 1 is a side view of a mounting system 10 for supporting a basketball backboard 12 including a basketball rim 14 mounted substantially parallel to a floor (not shown) and net 16 hanging from rim 14. Basketball backboard 12 includes an upper attachment 18 and a lower attachment 20. Mounting system 10 includes a support system 22 including a stationary member 24, an angled support assembly 26, and an actuator system 28. Stationary member 24 is hollow and includes an outer surface 30 and an inner surface (not shown in FIG. 1). Stationary member 24 also includes a first end 32, a second end 34, and an axis of symmetry 36 extending from first end 32 to second end 34. Stationary member 24 is mounted such that axis of symmetry 36 extends in a direction substantially perpendicular to the floor.

Angled support assembly 26 includes a first angled support member 38 and a second angled support member (not shown in FIG. 1). First angled support member 38 is mounted to stationary member 24 at an oblique angle 42 with respect to axis of symmetry 36. Angled support system 26 includes a bracket assembly 44. Bracket assembly 44 includes a bracket clamp 46 attached to stationary member 24. First angled support member 38 is attached to bracket clamp 46 with a pin 48 such that angled support system 26 is capable of retracting stationary member 24 which causes backboard 12 to be suspended such that backboard 12 is substantially parallel to the floor. The second angled support member is attached to stationary member 24 in a similar manner.

Actuator system 28 includes an adjustable member 50 having a first end 52 and a second end 54, and a drive mechanism assembly 56. Adjustable member 50 is a telescoping member that is hollow and tubular and includes an outer surface 58. Adjustable member 50 includes an axis of symmetry 59 which extends from first end 52 to second end 54. Adjustable member 50 is positioned within stationary member 24 in slidable contact. In one embodiment, outer surface 58 of adjustable member 50 is in slidable contact with the inner surface of stationary member 24. In a second embodiment, outer surface 30 of stationary member 24 is in slidable contact with the inner surface (not shown) of adjustable member 50. Outer surface 58 of adjustable member 50 also includes a plurality of markings 60 which indicate the height that rim 14 is positioned above the floor after adjustable member 50 is positioned.

Drive mechanism assembly 56 includes a rod 70 having a first end 72 and a second end 74. Rod 70 has a plurality of threads 76 attached and extending from first end 72 to second end 74. In another embodiment, rod 70 is a hydraulic cylinder assembly (not shown). First end 72 includes a thread stop 78 which limits the downward movement of adjustable member 50. Second end 74 includes a closed eyelet loop 80 which accepts a crank end (not shown) for adjusting the height of basketball rim 14 above the floor. In another embodiment, second end 74 accepts a pneumatic air wrench (not shown).

Drive mechanism assembly 56 also includes a thrust bearing 86 mounted to a fixed bracket 88 and including an opening 90. Thrust bearing 86 prevents axial movement of backboard 12. Fixed bracket 88 is attached between adjustable member 50 at second end 54 and backboard 12 at lower attachment 20. A plurality of threaded connectors 92 extend through backboard 12 and connect rim 14 to fixed bracket 88. Attaching rim 14 to fixed bracket 88 eliminates an amount of potential strain which would be induced on backboard 12 if fixed bracket 88 was attached directly to backboard 12.

Fixed bracket 88 includes an opening 94. Thrust bearing or collar 86 is mounted to fixed bracket 88 such that opening 90 is positioned concentrically over opening 94 so that rod 70 can extend therethrough. Opening 94 is sized to receive rod 70, but closed eyelet loop 80 cannot fit within opening 94 and as such, closed eyelet loop 80 is a limit to the upward movement of adjustable member 50. For example, when closed eyelet loop 80 is in a position of close proximity to second end 34 of stationary member 24, as shown in FIG. 1, the height of backboard 12 from the floor is maximized and mounting system 10 is in a "fully elevated" position. In one embodiment, a maximized height of rim 14 when backboard 12 is in a "fully elevated" position is 10 feet above the floor.

Figure 5:
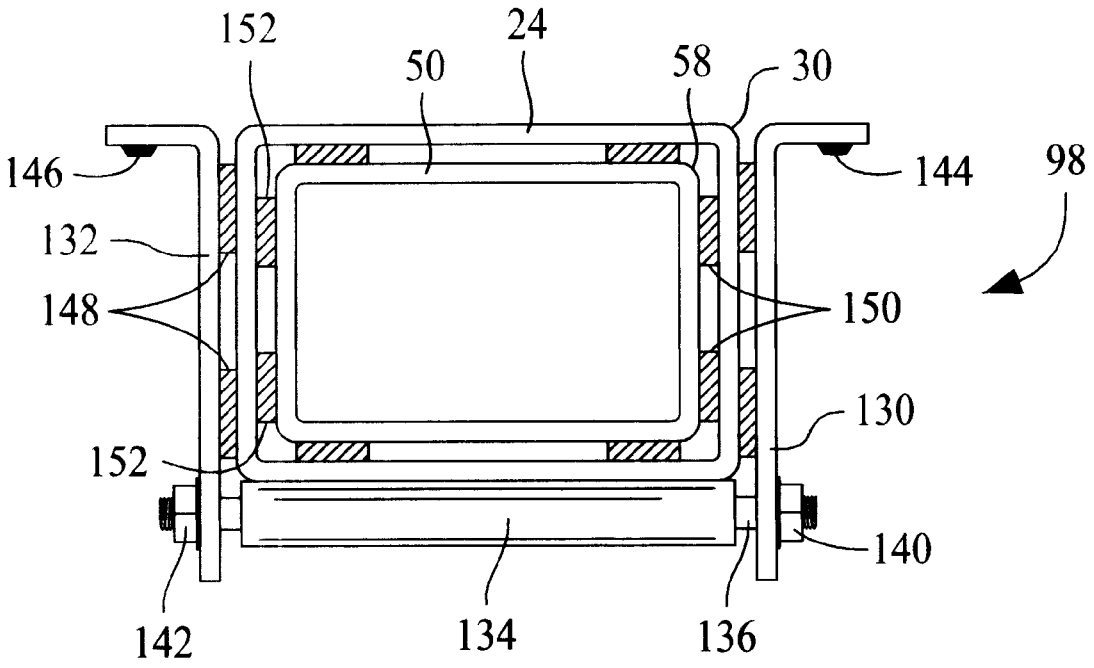
FIG. 5 is an enlarged view of one of the roller assemblies as seen from above.

Drive mechanism assembly 56 also includes a roller assembly 98 and a stationary nut 100 including an opening 102 which receives threads 76 of rod 70. Opening 102 is sized so that rod 70 is received therethrough, but thread stop 78 cannot fit within opening 102. Thread stop 78 prevents rod 70 from slipping through nut 100. Opening 102 is also sized such that as rod 70 is adjusted upwardly, thrust bearing 86 will contact stationary nut 100 and will not enter opening 102. Nut 100 is fixedly mounted to a bracket 104 attached to stationary member 24 in close proximity to second end 34. Drive mechanism assembly 56 is positioned such that rod 70 extends through fixed bracket 88 and thrust bearing 86 into stationary nut 100 in a direction substantially parallel to axis of symmetry 36. Roller assembly 98, described below in FIG. 5, is attached to backboard 12 at upper attachment 18 and is slidably attached to stationary member 24.

Figure 2:
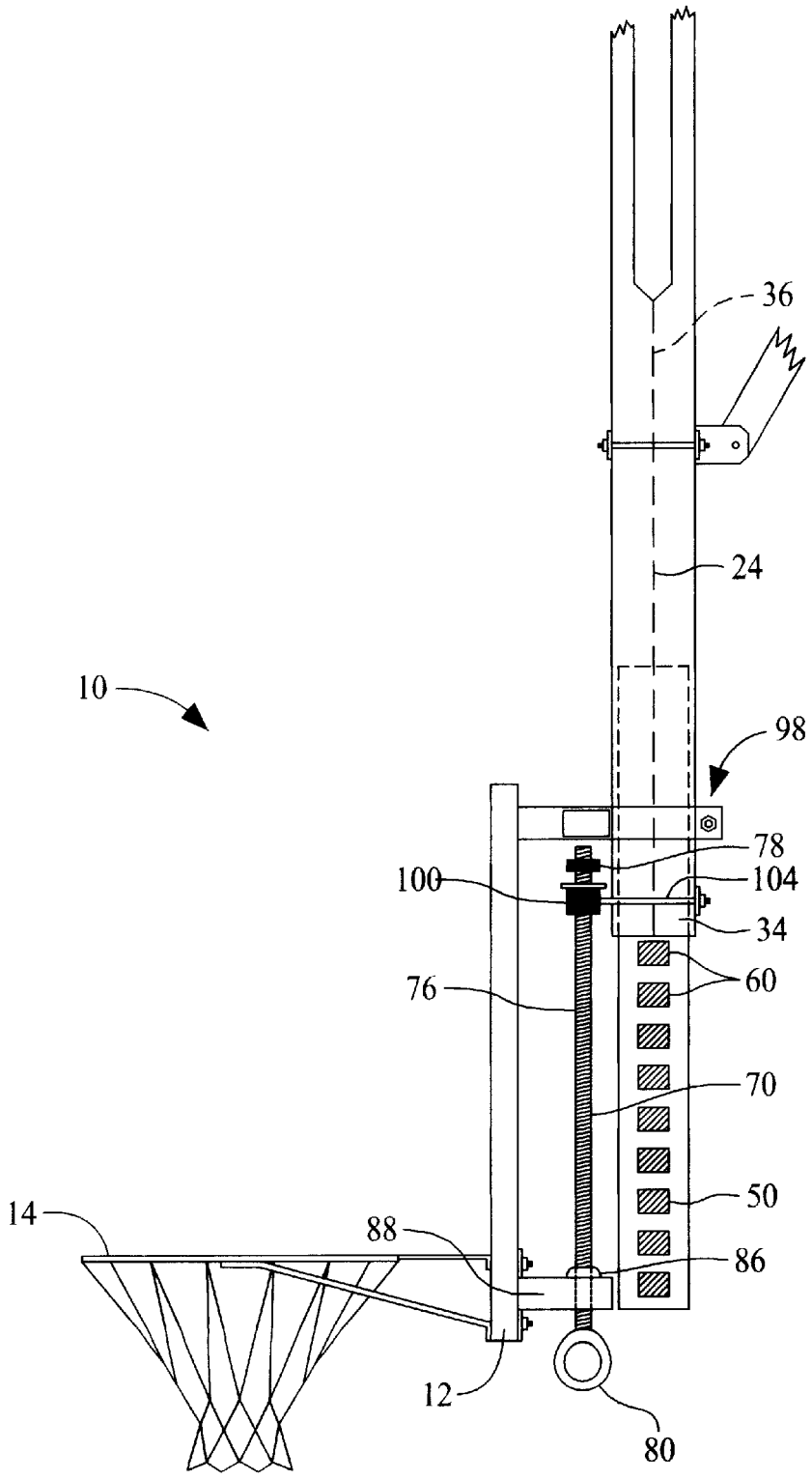
FIG. 2 is a side view of the mounting system shown in FIG. 1 in a lowered position.

FIG. 2 is a side view of mounting system 10 in which closed eyelet loop 80 is positioned in distant proximity to second end 34 of stationary member 24. When closed eyelet 80 has been fully rotated clockwise, thread stop 78 contacts stationary nut 100 and stops the rotation of rod 70 and the downward movement of adjustable member 50. The height of backboard 12 from the floor is minimized and mounting system 10 is in a "fully lowered" position. In a one embodiment, rim 14 is 8 feet above the floor when mounting system 10 is in a "fully lowered" position.

In operation, a crank end (not shown) is upwardly extended and inserted into closed eyelet loop 80. The crank is rotated counter-clockwise to raise rim 14 and clockwise to lower rim 14. The movement of rod 70 is limited in a counter-clockwise direction by thrust bearing 86 and in a clockwise direction by thread stop 78. As the crank is rotated clockwise, closed eyelet loop 80 is rotated which causes rod 70 to rotate. As rod 70 rotates, threads 76 are rotated clockwise through stationary nut 100 causing rod 70 to extend downwardly towards the floor in a direction parallel to axis of symmetry 36. As rod 70 extends downward, fixed bracket 88 and roller assembly 98 slide downward causing adjustable member 50 to simultaneously extend downward. The crank is continuously rotated until marking 60 indicates that adjustable member 50 is positioned at a desired height for rim 14. To raise rim 14, the crank is continuously rotated counter-clockwise until marking 60 indicates that adjustable member 50 has positioned rim 14 at a desired height.

Figure 3:
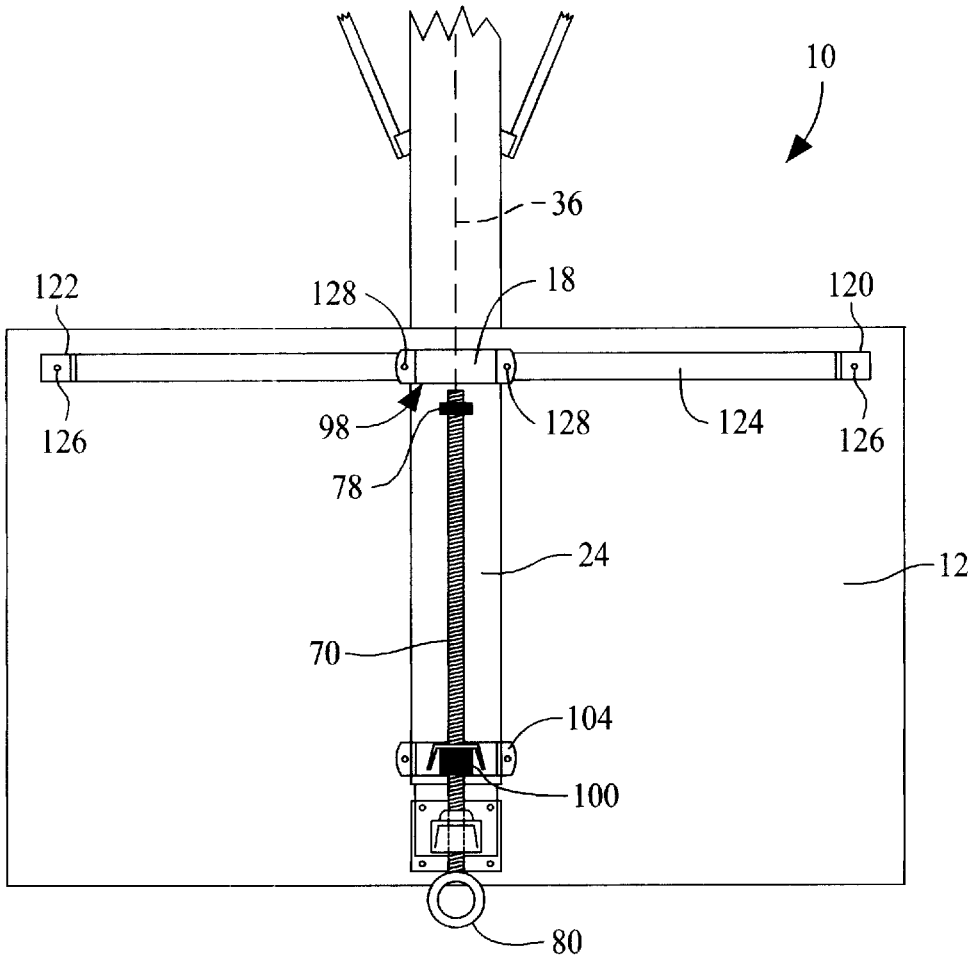
FIG. 3 is a front view of the mounting system shown in FIG. 1 without a basketball rim attached.

FIG. 3 is a front view of mounting system 10 and includes upper attachment 18 and backboard 12 without basketball rim 14 attached. Upper attachment 18 includes a pair of backboard brackets 120 and 122, and a backboard brace 124. Backboard brace 124 is mounted substantially parallel to a floor and extends between backboard brackets 120 and 122. Backboard brace 124 is positioned between backboard 12 and first stationary member 24 and provides support to backboard 12. Backboard brace 124 also reduces torsional and rotational stresses on backboard 12. Backboard brackets 120 and 122 extend substantially perpendicularly from backboard 12 and are mounted at a distant proximity from axis of symmetry 36 using a set of threaded connectors 126. Roller assembly 98 is attached to backboard brace 124 using a set of threaded connectors 128.

Figure 4:
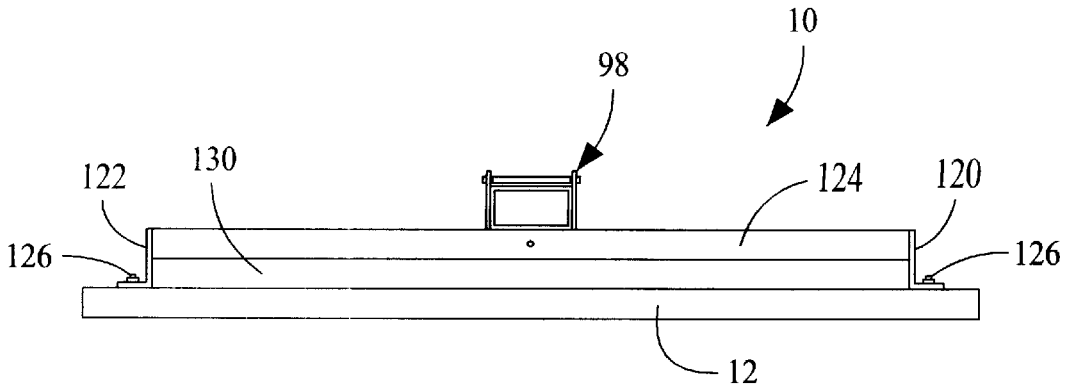
FIG. 4 is a plan view of the mounting system shown in FIG. 3.

FIG. 4 is a plan view of mounting system 10 including backboard 12 without rim 14 attached. Backboard brace 124 is mounted to brackets 120 and 122 and is substantially perpendicular to stationary member 24. Brackets 120 and 122 extend from backboard 12 and create a gap 130 between backboard brace 124 and backboard 12.

FIG. 5 is an enlarged view of roller assembly 98 as seen from above. Roller assembly 98 includes a first bracket 130, a second bracket 132, and a roller mechanism 134. Roller mechanism 134 is mounted on an axle 136 which is mounted between brackets 130 and 132 with threaded connectors 140 and 142. Roller mechanism 134 is positioned in slidable contact with outer surface 30 of stationary member 24. Brackets 130 and 132 are positioned adjacent outer surface 30 and are mounted to backboard brace 124 (shown in FIG. 4) using connectors 144 and 146. Roller mechanism 134 also includes a set of bearing plates 148 mounted to first bracket 130 between first bracket 130 and outer surface 30 of stationary member 24 and mounted to second bracket 132 between second bracket 132 and outer surface 30 of stationary member 24. Bearing plates 148 provide a smooth surface 149 between roller mechanism 134 and stationary member 24. Bearing plates 148 are fabricated from Teflon® material. Alternatively, bearing plates 148 are manufactured from Special Tivar 1000® material.

Adjustable member 50 also includes a set of bearing plates 150 mounted to outer surface 58 and positioned between outer surface 58 and the inner surface of stationary member 24. Bearing plates 150 provide a smooth surface 152 between adjustable member 50 and stationary member 24. Bearing plates 150 are fabricated from cold rolled steel that is greased and oiled.

Stationary member 24 and adjustable member 50 are fabricated from similarly shaped members to prevent either member 24 or 50 from rotating with respect to the other member 50 or 24. In one embodiment stationary member 24 is fabricated of 5"×7" rectangular steel tubing and adjustable member 50 is fabricated from 4.5"×6.4" rectangular steel tubing. In another embodiment, stationary member 24 and adjustable member 50 are fabricated from steel tubing having a circular cross-sectional area.

In another mounting embodiment, mounting assembly 10 includes stationary member 24 and does not include adjustable member 50. Rather, a second roller assembly (not shown) is attached to stationary member 24 in close proximity to roller assembly 98. Lower attachment 20 is attached to a support brace assembly (not shown) mounted to backboard 12. The support brace assembly comprises a first member (not shown) positioned substantially parallel to the floor and a plurality of members (not shown) extending upwardly from the first member and connected to bracket 124. The support brace assembly provides support to backboard 12 and alleviates potential torsional and twisting forces on backboard 12.

Figure 6:
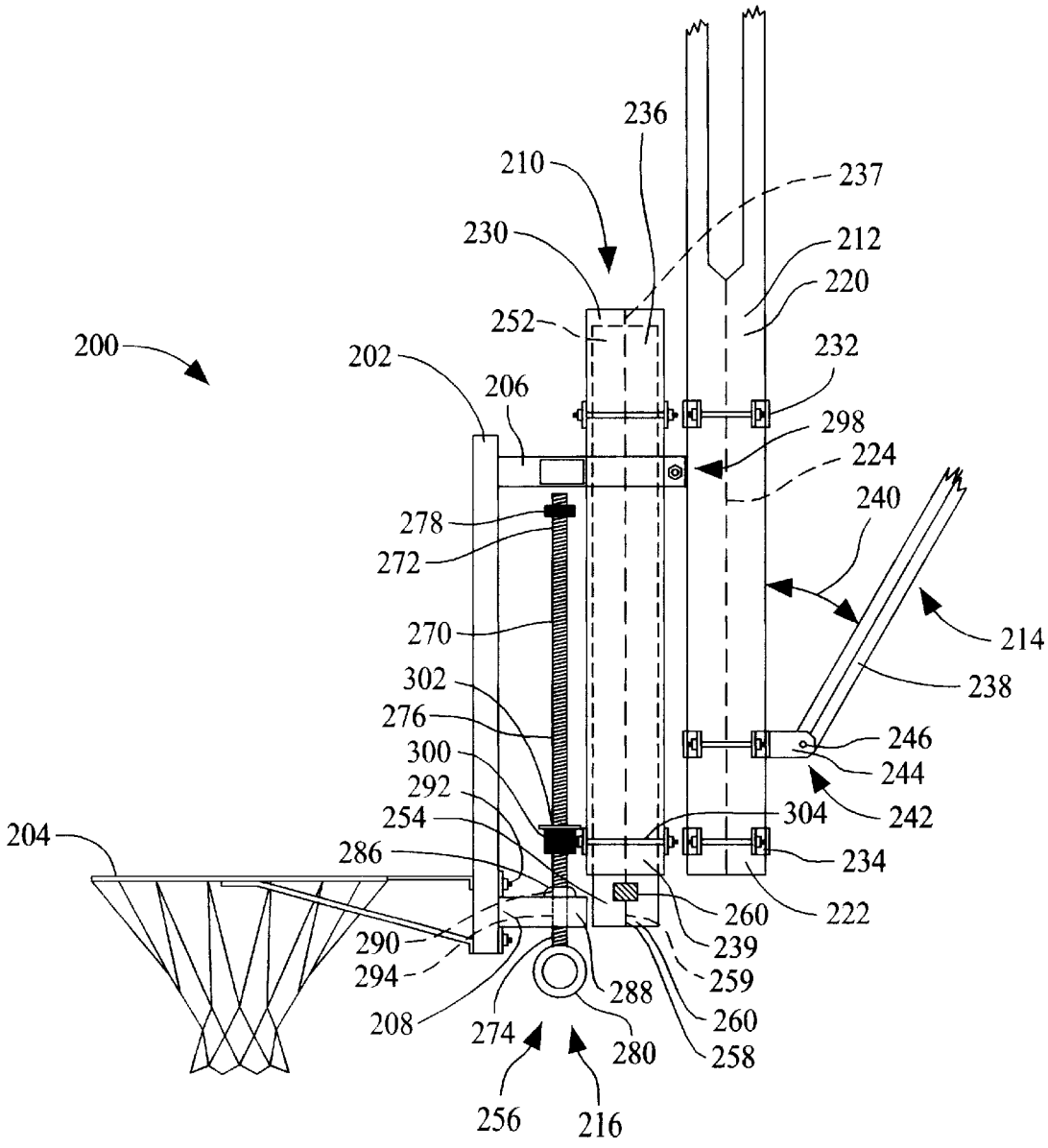
FIG. 6 is a side view of a mounting system for supporting a basketball backboard in accordance with a second embodiment of the present invention.

FIG. 6 is a side view of a mounting system 200 for supporting a basketball backboard 202 including a basketball rim 204 mounted substantially parallel to a floor (not shown). Basketball backboard 202 includes an upper attachment 206 and a lower attachment 208. Mounting system 200 includes a support system 210 including a first stationary member 212, an angled support assembly 214, and an actuator system 216. First stationary member 212 includes a first end 220, a second end 222, and an axis of symmetry 224 which extends from first end 220 to second end 222. A second stationary member 230 is mounted to first stationary member 212 with an upper bracket 232 and a lower bracket 234. Second stationary member 230 is hollow and includes an outer surface 236 and an inner surface (not shown). Second stationary member 230 also includes an axis of symmetry 237 which is substantially parallel to axis of symmetry 224 and a second end 239.

Angled support system 214 includes a first angled support member 238 and a second angled support member (not shown) each mounted to first stationary member 212 at an oblique angle 240 with respect to axis of symmetry 224. Angled support system 214 includes a bracket assembly 242 including a bracket clamp 244 attached to first stationary member 212. Angled support member 238 is attached to bracket clamp 244 with a pin 246 such that angled support system 214 is capable of retracting first stationary member 212 which causes backboard 202 to be suspended substantially parallel to the floor. The second angled support member is attached to first stationary member 212 in a similar manner.

Actuator system 216 includes an adjustable member 250 having a first end 252 and a second end 254 and a drive mechanism assembly 256. Adjustable member 250 is hollow, includes an outer surface 258, and is telescoping. Adjustable member 250 includes an axis of symmetry 259 which extends from first end 252 to second end 254 and is positioned substantially co-axially with axis of symmetry 237. Adjustable member 250 is positioned in slidable contact within second stationary member 230. In one embodiment outer surface 258 is in slidable contact with the inner surface of second stationary member 230.

Adjustable member 250 also includes a plurality of markings 260 attached to outer surface 258 which indicate the height rim 204 is positioned above the floor after adjustable member 250 is positioned.

Drive mechanism assembly 256 includes a rod 270 having a first end 272 and a second end 274. Rod 270 has a plurality of threads 276 extending from first end 272 to second end 274. First end 272 includes a thread stop 278 which limits the downward movement of adjustable member 250. Second end 274 includes a closed eyelet loop 280 which accepts a crank end (not shown) for re-positioning rim 204 above the floor.

Drive mechanism assembly 256 also includes a thrust bearing 286 mounted to a fixed bracket 288 and including an opening 290. Thrust bearing 286 prevents axial movement of backboard 202. Fixed bracket 288 is attached between adjustable member 250 at second end 254 and backboard 202. Fixed bracket 288 attaches to basketball rim 204 using threaded connectors 292 which extend from rim 204 through backboard 202 to fixed bracket 288. Attaching rim 204 to fixed bracket 288 alleviates potential strain which would be induced by attaching fixed bracket 288 directly to backboard 202.

Fixed bracket 288 includes an opening 294. Thrust bearing 286 is mounted to fixed bracket 288 such that opening 290 is positioned concentrically over opening 294 and rod 270 extends therethrough. Opening 294 is sized to receive rod 270 therethrough, but closed eyelet loop 280 can not fit within opening 294 and as such, closed eyelet loop 280 limits a distance that adjustable member 250 can be adjusted upwardly. For example, when closed eyelet loop 280 is in a position of close proximity to second end 239 of second stationary member 230, the height of backboard 202 above the floor is maximized and mounting system 200 is in a "fully elevated" position. In a preferred embodiment, rim 204 is 10 feet above the floor when in a "fully elevated" position.

Drive mechanism assembly 256 also includes a roller assembly 298 and a stationary nut 300 including an opening 302 sized to circumferentially receive threads 276 of rod 270. Opening 302 is sized such that rod 270 is received therethrough, but thread stop 278 cannot fit within opening 302 and as such, thread stop 278 prevents rod 270 from slipping through nut 300. Opening 302 is also sized such that as rod 270 is adjusted upwardly, thrust bearing 286 will contact stationary nut 300 and will not enter opening 302. Nut 300 is fixedly mounted to a bracket 304 mounted to second stationary member 230. Drive mechanism assembly 256 is positioned such that rod 270 extends through fixed bracket 288 and thrust bearing 286 into stationary nut 300 in a direction substantially parallel to axis of symmetry 236. Roller assembly 298 is attached to backboard 202 at upper attachment 206 and is slidably attached to second stationary member 230.

Figure 7:
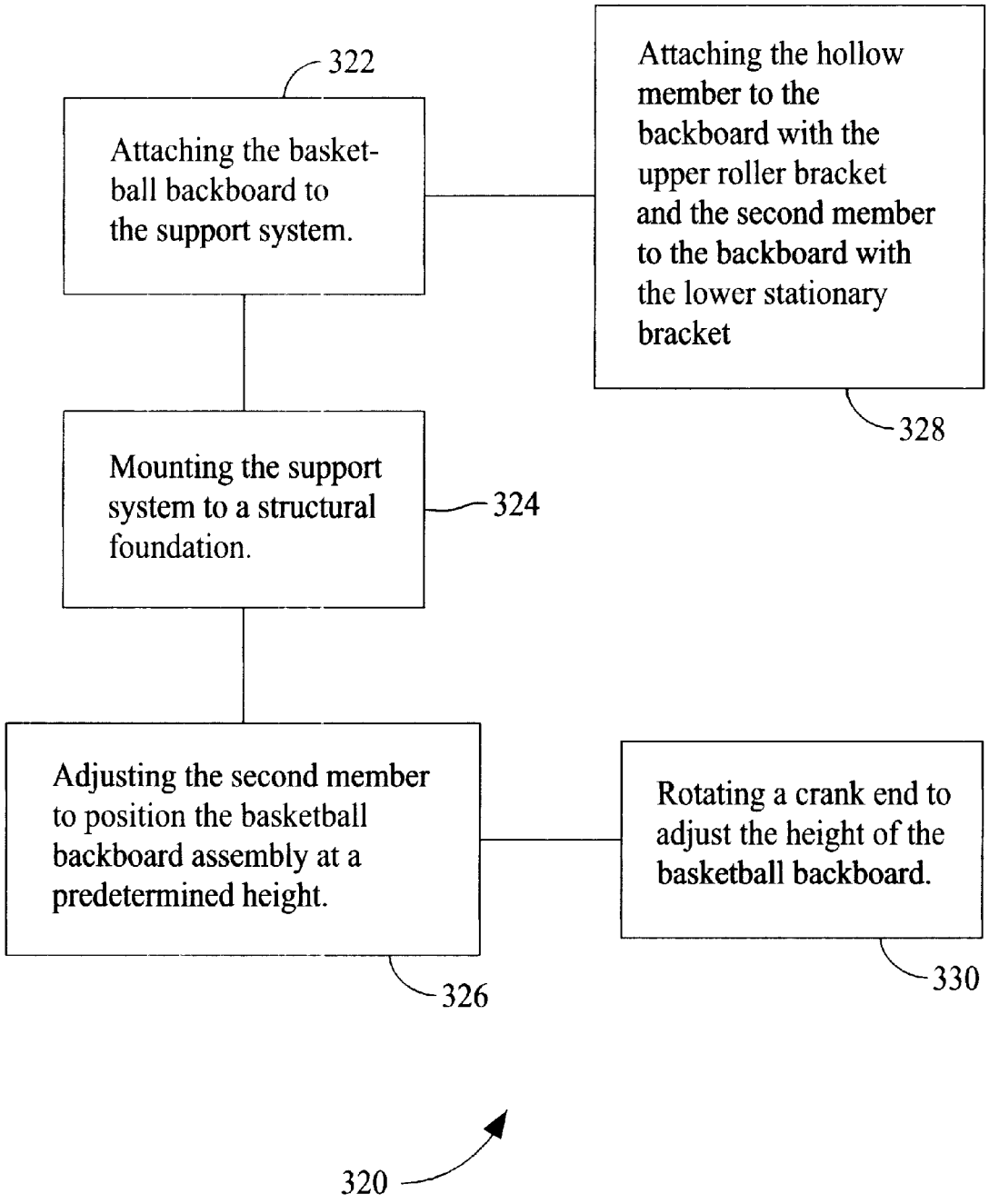
FIG. 7 is a flow chart of a method for mounting a basketball backboard assembly to a structural foundation.

In FIG. 7 is a flow chart 320 of a method for mounting a basketball backboard assembly to a structural foundation. In one embodiment, the method includes attaching 322 the backboard to the support system, and mounting 324 the support system to a structural foundation. In another embodiment, the method includes adjusting 326 the second member to position backboard assembly at a predetermined height. In a further embodiment, the method includes attaching 328 the hollow member to the backboard with the upper roller bracket and the second member to the backboard with the lower stationary bracket. In another embodiment, the method includes rotating 330 a crank end to adjust the height of the basketball backboard summary, the present invention provides a mounting system for a basketball backboard assembly which combines a support system and an actuator system. The support system includes a plurality of hollow members which provide rigidity for the basketball backboard assembly. The actuator system includes a telescoping member and a plurality of bracket assemblies which permit the basketball backboard assembly to be rapidly adjusted by an individual. Furthermore, the actuator system includes a drive mechanism which can be motorized. As a result, a mounting system is provided which easily and reliably adjusts the height of a basketball backboard without requiring tedious on-site installation procedures.

While the invention has been described in terms of various specific embodiments, those skilled in the art will recognize that the invention can be practiced with modifications within the spirit and scope of the claims.

What is claimed is:

1. A mounting system for supporting a basketball backboard comprising:

a support system comprising a single pair of members, said single pair of members comprising a first stationary member and a second member, said second member telescoping internally from said first member and attached to the basketball backboard;

a collar comprising a first end and a second end, said first end attached to the basketball backboard, said second end slidably attached to said first member;

a drive mechanism attached between said first member and said second member and configured to control a movement of said mounting system.

2. A mounting system in accordance with claim 1 wherein said support system first member is tubular, said support system second member is a telescoping member attached within said support system first member.

3. A mounting system in accordance with claim 1 wherein said support system first member has a rectangular cross-sectional profile.

4. A mounting system in accordance with claim 3 wherein said support system second member has a rectangular cross-sectional profile smaller than said first member rectangular cros-sectional profile, said second member rectangular cross-sectional profile in slidable engagement with said first member rectangular cross-sectional profile.

5. A mounting system in accordance with claim 4 wherein said second member comprises an axis of symmetry and a bracket comprising an opening therethrough, said drive mechanism comprises:

a rod comprising a first end, a second end, and a plurality of threads, said rod extending through said second member bracket opening in a direction substantially parallel to said second member axis of symmetry;

a collar comprising an opening and attached to said rod first end, said collar adjacent said second member bracket, said collar opening concentric with said bracket opening;

a stationary nut attached to said first member and configured to receive said rod second end; and an eyelet attached to said rod first end and configured to receive a crank to rotate said rod to adjust a height of the backboard.

6. A mounting system in accordance with claim 5 wherein said bracket comprises a roller bracket circumferentially mounted around and in slidable contact with said stationary member, and a fixed bracket mounted to said second end of said adjustable member, said roller bracket configured to be attached to said upper attachment assembly of the backboard, said fixed bracket configured to be attached to said lower attachment point of the backboard.

7. A mounting system in accordance with claim 6 wherein said support system further comprises a second stationary member including a first end and a second end, said second stationary member attached substantially parallel to said stationary member between said first member and the basketball backboard.

8. A mounting system in accordance with claim 7 wherein said plurality of brackets comprises two fixed bracket assemblies mounted to said first member configured to attach said second stationary member to said first member.

9. A mounting system in accordance with claim 8 wherein said plurality of brackets further comprises a slidable bracket circumferentially mounted around said second stationary member.

10. A mounting system in accordance with claim 9 wherein said slidable bracket is attached to said upper attachment.

* * * * *